US008128422B2

(12) United States Patent
Mellott et al.

(10) Patent No.: US 8,128,422 B2
(45) Date of Patent: Mar. 6, 2012

(54) VOICE-DIRECTED PORTABLE TERMINALS FOR WIRELESS COMMUNICATION SYSTEMS

(75) Inventors: Mark Bradford Mellott, Pittsburgh, PA (US); Douglas Mark Zatezalo, Allison Park, PA (US); James Randall Logan, Pittsburgh, PA (US); Ryan Anthony Zoschg, Oakmont, PA (US); Michael Davis, White Oak, PA (US); Graham Keith Lacy, London (GB); Steven McLellan, London (GB); Ian Heseltine, London (GB)

(73) Assignee: Vocollect, Inc., Pittsburgh, PA (US)

( * ) Notice: Subject to any disclaimer, the term of this patent is extended or adjusted under 35 U.S.C. 154(b) by 1641 days.

(21) Appl. No.: 10/982,967

(22) Filed: Nov. 5, 2004

(65) Prior Publication Data

US 2005/0095899 A1 May 5, 2005

Related U.S. Application Data

(63) Continuation of application No. 10/185,300, filed on Jun. 27, 2002, now Pat. No. 6,910,911.

(51) Int. Cl.
*H01R 13/62* (2006.01)

(52) U.S. Cl. ..... 439/180; 439/358

(58) Field of Classification Search ..... 439/180, 439/358, 357, 289, 700, 824, 37, 822, 341, 439/376, 923

See application file for complete search history.

(56) References Cited

U.S. PATENT DOCUMENTS

| | | | | |
|---|---|---|---|---|
| 1,483,315 | A | 2/1924 | Saal | |
| 1,753,317 | A | 4/1930 | Rothen | |
| 2,170,287 | A | 8/1939 | Kinnebrew | 173/330 |
| D130,619 | S | 12/1941 | Kendall | |
| 2,369,860 | A | 2/1945 | Schroeder | 173/328 |
| D153,112 | S | 3/1949 | Braun et al. | |
| 2,506,524 | A | 5/1950 | Stuck | |
| 2,782,423 | A | 2/1957 | Wiegand et al. | |
| 2,958,769 | A | 11/1960 | Bounds | |
| 3,087,028 | A | 4/1963 | Ernest | |
| D196,654 | S | 10/1963 | Van Den Berg | |
| D206,122 | S | 11/1966 | Bradbury et al. | |
| 3,327,807 | A | 6/1967 | Mullin | |
| 3,363,214 | A | 1/1968 | Wright | 339/12 |
| D206,665 | S | 12/1968 | Pollak | |
| D212,863 | S | 12/1968 | Roberts | |

(Continued)

FOREIGN PATENT DOCUMENTS

DE 4111049 10/1991

(Continued)

OTHER PUBLICATIONS 10 photographs of previous Vocollect terminal.

(Continued)

*Primary Examiner* — Felix O Figueroa

(74) *Attorney, Agent, or Firm* — Wood, Herron & Evans, LLP

(57) ABSTRACT

A communication system includes a voice-directed portable terminal with a voice user interface that is configured for being able to communicate with a computer system. The communication system includes a peripheral device having a cord coupled with the portable terminal and a connector adapted to disconnect from the portable terminal when a sufficient force is applied to the cord. This disengages the peripheral device from the portable terminal. The ability of the cord to break-away from the portable terminal prevents damage not only to the connector, but also to the cord, peripheral, and terminal.

10 Claims, 6 Drawing Sheets

U.S. PATENT DOCUMENTS

| | | | | |
|---|---|---|---|---|
| D215,545 | S | | 10/1969 | Husks |
| 3,654,406 | A | | 4/1972 | Reinthaler |
| 3,682,268 | A | | 8/1972 | Gorike |
| 3,781,039 | A | | 12/1973 | Locke et al. ..... 285/1 |
| 3,808,577 | A | | 4/1974 | Mathauser ..... 339/12 |
| 3,873,757 | A | | 3/1975 | Berke et al. |
| 3,969,796 | A | | 7/1976 | Hodsdon |
| 3,971,900 | A | | 7/1976 | Foley |
| 3,971,901 | A | | 7/1976 | Foley |
| 3,984,885 | A | | 10/1976 | Yoshimura et al. |
| 4,010,998 | A | * | 3/1977 | Tolnar et al. ..... 439/358 |
| 4,018,599 | A | | 4/1977 | Hill et al. |
| 4,024,368 | A | | 5/1977 | Shattuck |
| 4,031,295 | A | | 6/1977 | Rigazio |
| 4,039,765 | A | | 8/1977 | Tichy |
| 4,068,913 | A | | 1/1978 | Stanger et al. ..... 339/111 |
| 4,138,598 | A | | 2/1979 | Cech |
| 4,189,788 | A | | 2/1980 | Schenke |
| 4,213,253 | A | | 7/1980 | Gudelis |
| RE30,662 | E | | 6/1981 | Foley |
| 4,302,635 | A | | 11/1981 | Jacobsen |
| D265,989 | S | | 8/1982 | Harris |
| D268,675 | S | | 4/1983 | Hass |
| 4,418,248 | A | | 11/1983 | Mathis |
| 4,471,496 | A | | 9/1984 | Gardner |
| 4,472,607 | A | | 9/1984 | Houng |
| 4,495,646 | A | | 1/1985 | Gharachorloo |
| 4,499,593 | A | | 2/1985 | Antle |
| 4,619,491 | A | | 10/1986 | Drogo ..... 339/45 |
| 4,620,760 | A | | 11/1986 | Duncan ..... 339/45 |
| 4,634,816 | A | | 1/1987 | O'Malley et al. |
| 4,649,332 | A | | 3/1987 | Bell ..... 320/7 |
| 4,672,672 | A | | 6/1987 | Eggert et al. |
| 4,689,822 | A | | 8/1987 | Houng |
| 4,698,717 | A | | 10/1987 | Scheid ..... 361/1 |
| 4,739,328 | A | | 4/1988 | Koelle |
| D299,129 | S | | 12/1988 | Wiegel |
| 4,811,243 | A | | 3/1989 | Racine |
| 4,821,318 | A | | 4/1989 | Wu |
| D301,145 | S | | 5/1989 | Besasie et al. |
| 4,845,650 | A | | 7/1989 | Meade et al. |
| 4,846,714 | A | | 7/1989 | Welsby et al. ..... 439/348 |
| 4,864,158 | A | | 9/1989 | Koelle et al. |
| 4,874,316 | A | | 10/1989 | Kamon et al. ..... 439/39 |
| 4,875,233 | A | | 10/1989 | Derhaag |
| 4,888,591 | A | | 12/1989 | Landt et al. |
| 4,907,266 | A | | 3/1990 | Chen |
| 4,914,704 | A | | 4/1990 | Cole et al. |
| 4,952,024 | A | | 8/1990 | Gale |
| D313,092 | S | | 12/1990 | Nilsson |
| 4,999,636 | A | | 3/1991 | Landt et al. |
| 5,003,589 | A | | 3/1991 | Chen |
| 5,010,495 | A | | 4/1991 | Willetts |
| 5,012,511 | A | | 4/1991 | Hanle |
| 5,018,599 | A | | 5/1991 | Dohi et al. |
| 5,023,824 | A | | 6/1991 | Chadima et al. |
| 5,024,604 | A | | 6/1991 | Savin et al. ..... 439/345 |
| D318,670 | S | | 7/1991 | Taniguchi |
| 5,028,083 | A | | 7/1991 | Mischenko |
| 5,030,807 | A | | 7/1991 | Landt et al. |
| 5,055,659 | A | | 10/1991 | Hendrick et al. |
| 5,056,161 | A | | 10/1991 | Breen |
| D321,879 | S | | 11/1991 | Emmerling |
| 5,063,600 | A | | 11/1991 | Norwood |
| D326,655 | S | | 6/1992 | Iribe |
| 5,148,155 | A | | 9/1992 | Martin et al. |
| 5,155,659 | A | | 10/1992 | Kunert |
| D330,704 | S | | 11/1992 | Wagner |
| 5,177,784 | A | | 1/1993 | Hu |
| 5,179,736 | A | | 1/1993 | Scanlon |
| D334,043 | S | | 3/1993 | Taniguchi et al. |
| 5,197,332 | A | | 3/1993 | Shennib |
| 5,202,197 | A | | 4/1993 | Ansell et al. |
| 5,225,293 | A | | 7/1993 | Mitchell |
| 5,241,488 | A | | 8/1993 | Chadima |
| 5,251,105 | A | | 10/1993 | Kobayashi |
| D341,567 | S | | 11/1993 | Acker |
| 5,267,181 | A | | 11/1993 | George |
| 5,280,159 | A | | 1/1994 | Schultz |
| 5,281,957 | A | | 1/1994 | Schoolman |
| D344,494 | S | | 2/1994 | Cardenas |
| D344,522 | S | | 2/1994 | Taniguchi |
| 5,305,244 | A | | 4/1994 | Newman et al. |
| 5,309,359 | A | | 5/1994 | Katz |
| 5,347,477 | A | | 9/1994 | Lee |
| D351,841 | S | | 10/1994 | Blankenship et al. |
| 5,365,050 | A | | 11/1994 | Worthington et al. |
| 5,365,434 | A | | 11/1994 | Figliuzzi |
| 5,369,857 | A | | 12/1994 | Sacherman et al. |
| 5,371,679 | A | | 12/1994 | Abe et al. ..... 364/468 |
| 5,381,486 | A | | 1/1995 | Ludeke |
| 5,386,494 | A | | 1/1995 | White |
| 5,393,239 | A | | 2/1995 | Ursich ..... 439/180 |
| 5,399,102 | A | | 3/1995 | Devine ..... 439/505 |
| 5,406,037 | A | | 4/1995 | Nageno |
| 5,432,510 | A | | 7/1995 | Matthews |
| 5,438,626 | A | | 8/1995 | Neuman |
| 5,438,698 | A | | 8/1995 | Burton et al. |
| 5,446,788 | A | | 8/1995 | Lucey et al. |
| 5,456,611 | A | | 10/1995 | Henry et al. ..... 439/180 |
| 5,462,452 | A | | 10/1995 | Devine ..... 439/505 |
| 5,478,252 | A | | 12/1995 | Lecomte et al. ..... 439/180 |
| 5,479,001 | A | | 12/1995 | Kumar |
| 5,480,313 | A | | 1/1996 | d'Alayer de Costemore d'Arc ..... 439/159 |
| 5,481,645 | A | | 1/1996 | Bertino |
| D367,256 | S | | 2/1996 | Tokunaga |
| 5,491,651 | A | | 2/1996 | Janik |
| 5,501,571 | A | | 3/1996 | Van Durrett et al. ..... 414/786 |
| 5,504,485 | A | | 4/1996 | Landt et al. |
| 5,510,795 | A | | 4/1996 | Koelle |
| 5,515,303 | A | | 5/1996 | Cargin et al. |
| 5,521,601 | A | | 5/1996 | Kandlur |
| 5,535,437 | A | | 7/1996 | Karl et al. |
| 5,550,547 | A | | 8/1996 | Chan et al. |
| 5,553,312 | A | | 9/1996 | Gattey et al. |
| 5,555,490 | A | | 9/1996 | Carroll |
| 5,555,554 | A | | 9/1996 | Hofer |
| 5,572,401 | A | | 11/1996 | Carroll |
| 5,579,400 | A | | 11/1996 | Ballein |
| D376,598 | S | | 12/1996 | Hayashi |
| 5,581,492 | A | | 12/1996 | Janik |
| 5,604,050 | A | | 2/1997 | Brunette et al. |
| 5,607,792 | A | | 3/1997 | Garcia et al. |
| D379,456 | S | | 5/1997 | Osiecki |
| D380,199 | S | | 6/1997 | Beruscha |
| 5,637,417 | A | | 6/1997 | Engmark |
| 5,639,256 | A | | 6/1997 | Endo et al. ..... 439/358 |
| D384,072 | S | | 9/1997 | Ng |
| 5,665,485 | A | | 9/1997 | Kuwayama et al. |
| 5,671,037 | A | | 9/1997 | Ogasawara et al. |
| 5,673,037 | A | | 9/1997 | Cesar et al. |
| D385,263 | S | | 10/1997 | Taylor |
| D385,540 | S | | 10/1997 | Taylor |
| D385,541 | S | | 10/1997 | Taylor |
| 5,680,465 | A | | 10/1997 | Boyden |
| D385,855 | S | | 11/1997 | Ronzani |
| D387,898 | S | | 12/1997 | Ronzani |
| D390,552 | S | | 2/1998 | Ronzani |
| D391,234 | S | | 2/1998 | Chacon et al. |
| 5,716,730 | A | | 2/1998 | Deguchi |
| 5,719,743 | A | | 2/1998 | Jenkins et al. |
| 5,719,744 | A | | 2/1998 | Jenkins et al. |
| D391,953 | S | | 3/1998 | Copeland |
| 5,729,697 | A | | 3/1998 | Schkolnick |
| D394,436 | S | | 5/1998 | Hall et al. |
| 5,748,841 | A | | 5/1998 | Morin |
| 5,757,339 | A | | 5/1998 | Williams et al. |
| 5,762,512 | A | | 6/1998 | Trant et al. |
| 5,763,867 | A | | 6/1998 | Main |
| 5,766,794 | A | | 6/1998 | Brunette et al. |
| 5,774,096 | A | | 6/1998 | Usuki et al. |
| 5,777,561 | A | | 7/1998 | Chieu et al. |
| 5,781,644 | A | | 7/1998 | Chang |
| 5,787,361 | A | | 7/1998 | Chen |
| 5,793,878 | A | | 8/1998 | Chang |
| D398,899 | S | | 9/1998 | Chaco |

5,803,750 A 9/1998 Purington et al. ..... 439/17
5,812,977 A 9/1998 Douglas
5,825,045 A 10/1998 Koenck et al.
5,828,693 A 10/1998 Mays et al.
D400,848 S 11/1998 Clark et al.
5,832,098 A 11/1998 Chen
5,841,630 A 11/1998 Seto et al.
5,841,859 A 11/1998 Chen
5,844,824 A 12/1998 Newman et al.
5,850,181 A 12/1998 Heinrich et al.
5,850,187 A 12/1998 Carrender et al.
5,856,038 A 1/1999 Mason
5,857,148 A 1/1999 Weisshappel et al.
5,862,241 A 1/1999 Nelson
D406,098 S 2/1999 Walter et al.
5,869,204 A 2/1999 Kottke et al.
5,873,070 A 2/1999 Bunte et al.
D406,575 S 3/1999 Michael et al.
5,884,265 A 3/1999 Squitteri
5,890,074 A 3/1999 Rydbeck
5,890,123 A 3/1999 Brown et al.
D408,783 S 4/1999 Lucaci et al.
5,892,813 A 4/1999 Morin et al.
5,895,729 A 4/1999 Phelps et al.
D409,137 S 5/1999 Sumita
5,903,870 A 5/1999 Kaufman
5,905,632 A 5/1999 Seto et al.
D410,466 S 6/1999 Mouri
D410,921 S 6/1999 Luchs et al.
D411,179 S 6/1999 Toyosato
5,909,667 A 6/1999 Leontiades
5,912,632 A 6/1999 Dieska et al.
5,931,513 A 8/1999 Conti
5,933,330 A 8/1999 Beutler et al.
5,934,911 A 8/1999 Stout et al. ..... 439/21
5,935,729 A 8/1999 Mareno
5,941,726 A 8/1999 Koegel et al. ..... 439/358
5,941,729 A 8/1999 Sri-Jayantha ..... 439/505
5,942,987 A 8/1999 Heinrich et al.
5,945,235 A 8/1999 Clanton et al.
D413,582 S 9/1999 Tompkins
D414,470 S 9/1999 Chacon
5,950,167 A 9/1999 Yaker
5,956,675 A 9/1999 Setlur et al.
5,962,837 A 10/1999 Main
5,966,082 A 10/1999 Cofino et al.
5,974,384 A 10/1999 Yasuda
D416,263 S 11/1999 Kuczyk et al.
5,984,709 A 11/1999 Zink et al. ..... 439/348
5,991,085 A 11/1999 Rallison et al.
5,991,726 A 11/1999 Immarco et al.
5,993,246 A 11/1999 Moldenhauer et al. ..... 439/474
5,995,019 A 11/1999 Chieu et al.
5,999,085 A 12/1999 Szwarc
6,012,030 A 1/2000 French-St. George et al.
6,016,347 A 1/2000 Magnasco
D420,674 S 2/2000 Powell
6,021,207 A 2/2000 Puthuff et al.
6,022,237 A 2/2000 Esh ..... 39/348
6,032,127 A 2/2000 Schkolnick
6,044,347 A 3/2000 Abella et al.
D422,962 S 4/2000 Shevlin et al.
6,051,334 A 4/2000 Tsurumaru
D424,035 S 5/2000 Steiner
D424,577 S 5/2000 Backs et al.
6,056,199 A 5/2000 Wiklof
6,060,193 A 5/2000 Remes
6,062,891 A 5/2000 Villiers ..... 439/348
D426,529 S 6/2000 Lohrding
6,071,640 A 6/2000 Robertson et al.
6,075,857 A 6/2000 Doss et al.
6,078,251 A 6/2000 Landt et al.
6,078,825 A 6/2000 Hahn et al.
6,084,556 A 7/2000 Zwern
6,085,428 A 7/2000 Casby et al.
6,091,546 A 7/2000 Spitzer
D430,158 S 8/2000 Bhatia
D430,159 S 8/2000 Bhatia et al.
6,101,260 A 8/2000 Jensen et al.
6,104,281 A 8/2000 Heinrich et al.
6,109,526 A 8/2000 Ohanian
D430,882 S 9/2000 Tsai
6,114,625 A 9/2000 Hughes et al.
6,120,932 A 9/2000 Slipy et al.
6,122,329 A 9/2000 Zai
D431,562 S 10/2000 Bhatia et al.
6,127,990 A 10/2000 Zwern
6,127,999 A 10/2000 Mizutani
6,136,467 A 10/2000 Phelps et al.
6,137,686 A 10/2000 Saye
6,137,868 A 10/2000 Leach
6,137,879 A 10/2000 Papadopoulos et al.
6,149,451 A 11/2000 Weber ..... 439/358
6,154,669 A 11/2000 Hunter et al.
D434,762 S 12/2000 Ikenaga
6,157,533 A 12/2000 Sallam
6,160,702 A 12/2000 Lee
6,164,853 A 12/2000 Foote
6,167,413 A 12/2000 Daley
D436,104 S 1/2001 Bhatia
D436,349 S 1/2001 Kim
6,171,138 B1 1/2001 Lefebvre et al.
6,172,596 B1 1/2001 Cesar et al.
6,173,266 B1 1/2001 Marx et al.
6,179,192 B1 1/2001 Weinger et al.
6,185,535 B1 2/2001 Hedin
6,188,985 B1 2/2001 Thrift
6,190,795 B1 2/2001 Daley
6,195,053 B1 2/2001 Kodukula
6,199,044 B1 3/2001 Ackley et al.
6,204,765 B1 3/2001 Brady et al.
D440,966 S 4/2001 Ronzani
6,225,777 B1 5/2001 Garcia et al.
6,226,622 B1 5/2001 Dabbiere ..... 705/28
6,229,694 B1 5/2001 Kono
6,230,029 B1 5/2001 Hahn et al.
6,233,559 B1 5/2001 Balakrishnan
6,233,560 B1 5/2001 Tannenbaum
6,235,420 B1 5/2001 Ng
6,237,051 B1 5/2001 Collins ..... 710/36
D443,870 S 6/2001 Carpenter et al.
6,243,682 B1 6/2001 Eghtesadi et al.
6,246,989 B1 6/2001 Polcyn
6,261,715 B1 7/2001 Nakamura et al.
6,266,641 B1 7/2001 Takaya
D448,027 S 9/2001 Jones et al.
6,286,763 B1 9/2001 Reynolds et al.
D449,289 S 10/2001 Weikel et al.
6,302,454 B1 10/2001 Tsurumaru
6,304,436 B1 10/2001 Branch et al. ..... 361/683
6,304,459 B1 10/2001 Toyosato et al.
6,310,888 B1 10/2001 Hamlin ..... 370/466
6,318,636 B1 11/2001 Reynolds et al.
6,321,198 B1 11/2001 Hank et al.
6,324,053 B1 11/2001 Kamijo
D451,903 S 12/2001 Amae et al.
D451,907 S 12/2001 Amae et al.
D451,919 S 12/2001 Abboud
6,325,507 B1 12/2001 Jannard
6,326,543 B1 12/2001 Lamp
6,327,152 B1 12/2001 Saye
6,339,764 B1 1/2002 Livesay et al. ..... 705/28
6,349,001 B1 2/2002 Spitzer
D454,468 S 3/2002 Mano
D454,873 S 3/2002 Clark et al.
6,353,313 B1 3/2002 Estep
6,356,635 B1 3/2002 Lyman et al.
6,357,534 B1 3/2002 Buetow et al.
6,357,662 B1 3/2002 Helton
6,359,603 B1 3/2002 Zwern
6,359,777 B1 3/2002 Newman
6,359,995 B1 3/2002 Ou
6,364,675 B1 4/2002 Brauer et al. ..... 439/159
6,369,952 B1 4/2002 Rallison et al.
6,371,535 B2 4/2002 Wei
6,373,693 B1 4/2002 Seto et al.
6,373,942 B1 4/2002 Braund
6,374,126 B1 4/2002 MacDonald, Jr. et al.

6,376,942 B1 4/2002 Burger
D457,133 S 5/2002 Yoneyama
6,384,591 B1 5/2002 Estep
6,384,712 B1 5/2002 Goldman
6,384,982 B1 5/2002 Spitzer
6,386,107 B1 5/2002 Rancourt
6,394,278 B1 5/2002 Reed
6,404,325 B1 6/2002 Heinrich
6,422,476 B1 7/2002 Ackley
6,424,357 B1 7/2002 Frulla
6,429,775 B1 8/2002 Martinez et al.
6,434,251 B1 8/2002 Jensen et al.
6,434,526 B1 8/2002 Cilurzo
6,438,523 B1 8/2002 Oberteuffer et al.
6,445,175 B1 9/2002 Estep
6,454,608 B1 9/2002 Kitahara et al. ..... 439/638
D463,784 S 10/2002 Taylor et al.
6,486,769 B1 11/2002 McLean
D466,497 S 12/2002 Wikel
D467,592 S 12/2002 Hussaini
6,496,799 B1 12/2002 Pickering
6,500,581 B2 12/2002 White et al.
6,501,807 B1 12/2002 Chieu
D469,080 S 1/2003 Kohli
6,504,914 B1 1/2003 Brademann et al.
6,509,546 B1 1/2003 Egitto
6,511,770 B2 1/2003 Chang
6,523,752 B2 2/2003 Nishitani et al.
6,525,648 B1 2/2003 Kubler
6,529,880 B1 3/2003 McKeen
6,532,148 B2 3/2003 Jenks
6,560,092 B2 5/2003 Itou et al.
D475,996 S 6/2003 Skulley
6,574,672 B1 * 6/2003 Mitchell et al. ..... 709/250
6,581,782 B2 6/2003 Reed
6,597,465 B1 7/2003 Jarchow
6,608,551 B1 8/2003 Anderson
D480,074 S 9/2003 Tuhkanen
6,628,509 B2 9/2003 Kono
6,639,509 B1 10/2003 Martinez
D483,281 S 12/2003 Cobigo
D483,369 S 12/2003 Klemettila
D483,370 S 12/2003 Klemettila
6,658,130 B2 12/2003 Huang
6,660,427 B1 12/2003 Hukill
6,677,852 B1 1/2004 Landt
D487,064 S 2/2004 Stekelenburg
6,697,465 B1 2/2004 Goss
D487,276 S 3/2004 Cobigo
D487,470 S 3/2004 Cobigo
D488,146 S 4/2004 Minto
D488,461 S 4/2004 Okada et al.
6,731,771 B2 5/2004 Cottrell
D491,917 S 6/2004 Asai
D491,953 S 6/2004 Arakaki et al.
D492,295 S 6/2004 Glatt
6,743,535 B2 6/2004 Yoneyama
6,745,014 B1 6/2004 Seibert
6,749,960 B2 6/2004 Takeshita
6,754,361 B1 6/2004 Hall
6,754,632 B1 6/2004 Kalinowski et al.
D494,571 S 8/2004 Polito
6,769,762 B2 8/2004 Saito et al.
6,769,767 B2 8/2004 Swab et al.
6,772,454 B1 8/2004 Barry
6,778,676 B2 8/2004 Groth et al.
6,811,088 B2 11/2004 Lanzaro et al.
6,812,852 B1 11/2004 Cesar
6,816,063 B2 11/2004 Kubler
6,826,532 B1 11/2004 Casby et al.
6,830,181 B1 12/2004 Bennett
6,847,336 B1 1/2005 Lemelson
6,853,294 B1 2/2005 Ramamurthy
6,859,134 B1 2/2005 Heiman et al.
6,872,080 B2 3/2005 Pastrick
6,890,273 B1 5/2005 Perez
D506,065 S 6/2005 Sugino et al.
6,909,546 B2 6/2005 Hirai
6,910,911 B2 6/2005 Mellott et al.
D507,523 S 7/2005 Resch et al.
6,915,258 B2 7/2005 Kontonassios
6,934,675 B2 8/2005 Glinski
6,965,681 B2 11/2005 Almqvist
D512,417 S 12/2005 Hirakawa et al.
D512,718 S 12/2005 Mori
D512,985 S 12/2005 Travers et al.
6,982,640 B2 1/2006 Lindsay et al.
7,003,464 B2 2/2006 Ferrans et al.
D517,556 S 3/2006 Cho
D518,451 S 4/2006 Nussberger
D519,497 S 4/2006 Komiyama
7,028,265 B2 4/2006 Kuromusha et al.
7,052,799 B2 5/2006 Zatezalo et al.
D522,897 S 6/2006 Kellond
7,063,263 B2 6/2006 Swartz et al.
D524,794 S 7/2006 Kim
D525,237 S 7/2006 Viduya et al.
7,082,393 B2 7/2006 Lahr
7,085,543 B2 8/2006 Nassimi
7,099,464 B2 8/2006 Lucey et al.
D528,031 S 9/2006 Kellond
7,110,800 B2 9/2006 Nagayasu et al.
7,110,801 B2 9/2006 Nassimi
D529,438 S 10/2006 Viduya et al.
D529,447 S 10/2006 Greenfield
D531,586 S 11/2006 Poulet
7,143,041 B2 11/2006 Sacks et al.
D533,184 S 12/2006 Kim
7,146,323 B2 12/2006 Guenther et al.
D535,974 S 1/2007 Alwicker et al.
D536,692 S 2/2007 Alwicker et al.
D537,978 S 3/2007 Chen
D539,816 S 4/2007 Aoki
7,216,351 B1 5/2007 Maes
D543,994 S 6/2007 Kurihara
7,228,429 B2 6/2007 Monroe
D548,220 S 8/2007 Takagi
D549,216 S 8/2007 Viduya
D549,217 S 8/2007 Viduya
D549,694 S 8/2007 Viduya et al.
7,257,537 B2 8/2007 Ross et al.
D551,615 S 9/2007 Wahl
D552,595 S 10/2007 Viduya et al.
D558,761 S 1/2008 Viduya et al.
D558,785 S 1/2008 Kofford
7,319,740 B2 1/2008 Engelke
7,346,175 B2 3/2008 Hui et al.
D565,569 S 4/2008 Viduya et al.
D567,218 S 4/2008 Viduya et al.
D567,219 S 4/2008 Viduya et al.
D567,799 S 4/2008 Viduya et al.
D567,806 S 4/2008 Viduya et al.
D568,881 S 5/2008 Hsiau
D569,358 S 5/2008 Devenish, III et al.
D569,876 S 5/2008 Griffin
7,369,991 B2 5/2008 Manabe et al.
D571,372 S 6/2008 Brefka et al.
D572,655 S 7/2008 Osiecki
D573,577 S 7/2008 Huang
D583,827 S 12/2008 Wahl
D587,269 S 2/2009 Keeports
7,487,440 B2 2/2009 Gergic et al.
7,496,387 B2 2/2009 Byford et al.
7,519,196 B2 4/2009 Bech
7,604,765 B2 10/2009 Sugimoto et al.
2001/0017926 A1 8/2001 Viamini
2001/0046305 A1 11/2001 Muranami
2002/0003889 A1 1/2002 Fischer
2002/0015008 A1 2/2002 Kishida
2002/0021551 A1 2/2002 Kashiwagi
2002/0052134 A1 5/2002 Revis
2002/0076060 A1 6/2002 Hall
2002/0131616 A1 9/2002 Bronnikov
2002/0178344 A1 11/2002 Bourguet
2003/0095525 A1 5/2003 Lavin
2003/0130852 A1 7/2003 Tanaka
2003/0233165 A1 12/2003 Hein
2004/0024586 A1 2/2004 Andersen

| | | | |
|---|---|---|---|
| 2004/0063475 | A1 | 4/2004 | Weng |
| 2004/0091129 | A1 | 5/2004 | Jensen |
| 2004/0220686 | A1 | 11/2004 | Cass |
| 2005/0010418 | A1 | 1/2005 | McNair |
| 2005/0230388 | A1 | 10/2005 | Wu |
| 2005/0272401 | A1 | 12/2005 | Zatezalo |
| 2007/0080930 | A1 | 4/2007 | Logan |
| 2007/0221138 | A1 | 9/2007 | Manimi |
| 2008/0072847 | A1 | 3/2008 | Liao |

FOREIGN PATENT DOCUMENTS

| | | |
|---|---|---|
| DE | 04138886 | 4/1993 |
| EP | 00732817 | 9/1996 |
| EP | 1383029 | 1/2004 |
| GB | 02242099 | 9/1991 |
| WO | WO0041543 | 7/2000 |
| WO | WO02069320 | 9/2002 |
| WO | WO2005008476 | 1/2005 |
| WO | WO2007/004755 | 1/2007 |

OTHER PUBLICATIONS

One-page Peripheral PDF's: http://cgi.ebay.com/USB-wireless-MOUSE-w-receiver-pocket-USB-HUB-PS-2-si_W0QQitemZ110007231278QQihZ001QQcategoryZ60264QQcmDZViewItem, Nov. 16, 2006.

Six-page www.vocollect.com—Vocollect PDF brochure, Nov. 2005.

Four-page Vocollect Speech Recognition Headsets brochure—Clarity and comfort. Reliable performance. Copyright Sep. 2005.

Four-page Vocollect Speech Recognition Headsets brochure—SR 30 Series Talkman High-Noise Headset. Copyright 2005.

Two-page Vocollect SR 20 Talkman Lightweight Headset Product Information Sheet. Copyright Aug. 2004.

Photographs 1-7 SR Talkman Headset Aug. 2004—Prior art.

Two-page Supplemental Vocollect SR 20, Talkman Lightweight Headset Product Information Sheet. Copyright Aug. 2004.

Photographs 1-8 SR Talkman Headset.

Fifteen-page Takebayashi, Spontaneous Speech Dialogu System TOSSBURG II—The User-Centered Multimodal Interface, Published Nov. 15, 2995.

Four-page Wang, "SALT: A Spoken Language Interface for Web-based Multimodal Dialog Systems," In Proc. ICSLP, 2002, pp. 2241-2244.

Three-page Bers, et al. "Designing Conversational Interfaces with Multimodal Interaction", DARPA Workshop on Broadcast News Understanding Systems, 1998, pp. 319-321.

US 6,335,860, 01/2002, Shin (withdrawn)

* cited by examiner

VOICE-DIRECTED PORTABLE TERMINALS FOR WIRELESS COMMUNICATION SYSTEMS

CROSS-REFERENCE TO RELATED APPLICATIONS

This application is a continuation of application Ser. No. 10/185,300 filed on Jun. 27, 2002 now U.S. Pat. No. 6,910,911, the disclosure of which is hereby incorporated in its entirety by reference herein.

FIELD OF THE INVENTION

This invention relates generally to portable terminals and more specifically, to wearable, portable and/or mobile terminals and peripherals for wireless communication systems.

BACKGROUND OF THE INVENTION

Wearable, portable and/or mobile terminals are used for a wide variety of tasks. Such terminals allow a worker using them to have mobility, while providing them with desirable computing and data-processing functions. Furthermore, various terminals provide a communication link to a larger, more centralized computer system. Such terminals are being implemented for an ever-increasing number of tasks.

One illustrative example of a specific use for a wearable or portable terminal is inventory management. Computerized inventory management systems are used in inventory-driven industries for various tasks, such as food and retail product distribution, manufacturing, and quality control. An overall integrated inventory management system involves a combination of a central computer system for tracking and management, and the people who use and interface with the computer system in the form of order fillers, pickers and other workers. The workers handle the manual aspects of the integrated management system.

To provide an interface between the central computer system and the workers, wearable or portable computers or terminals are used by the workers as they complete their numerous tasks. Such wearable terminals, for example, pull information directly from the central system and translate the information into voice or text commands for the workers. Through wireless radiofrequency (RF) networks, the commands to and responses from the workers are communicated between the system and the terminals. To communicate in a voice-driven system, for example, the worker wears a headset, which is coupled to their wearable terminal. Through the headset, the workers are able to receive voice instructions, ask questions, report the progress of their tasks, and report working conditions, such as inventory shortages, for example. Using such terminals, the work is done virtually hands-free without equipment to juggle or paperwork to carry around.

In addition to headsets, other peripherals are often coupled to the terminals depending upon the tasks to be performed. For example, bar code readers and other scanners may be utilized alone or in combination with a headset to communicate back and forth with the system.

An illustrative example of a job through a system utilizing wearable and/or portable terminals having voice capabilities may involve initially welcoming the worker to the system and defining a particular task or order, for example, a load to be filled for a certain truck to depart from a warehouse. The worker may then answer with a particular area (e.g., freezer) that they will be working in for that order. The system then vocally directs the worker to a particular aisle and bin to pick a particular quantity of an item. The worker then vocally confirms their location and the amount of items that are picked. The system may then direct them to a loading dock or bay for a particular truck to receive the order. As may be appreciated, various different scenarios might be played out through the system using a wearable terminal and attached peripherals.

The peripherals, such as a headset, are attached to a terminal with a cord, which extends generally from the terminal (typically worn on a belt) to the head of the worker where the headset is located. As may be appreciated, the workers are moving rapidly around their work area and are often jumping on and off forklifts, pallet loaders, and other equipment. Therefore, there is a possibility for a cord to get caught on some object, such as a forklift. When this occurs, the cord will tend to want to separate either from the headset or from the terminal. Generally, the cords are permanently attached to a headset and each worker maintains their own headset (e.g. for individual responsibility and/or hygiene purposes). The cords are then plugged into the terminals, therefore the separation will generally occur at the terminal socket.

Attempts have been made to appropriately handle a snagged cord and cord separation. However, there are competing issues that must be addressed. When the cord plug is strongly secured to the terminal socket, a snagged cord may pull the socket out of the terminal housing. This may render the terminal inoperable and require repair or replacement. However, strengthening the anchoring point of the socket in the terminal may lead to cords pulling away from their plug, thus rendering the headset unusable. Making the cord more securely attached with its plug, making the terminal socket securely anchored in the terminal housing, and then providing a secure coupling between the plug and the socket, however, may prevent separation but may leave the cord susceptible to catching on surrounding objects resulting in damage to the cord and/or the plug.

Therefore, it is desirable to improve upon the conventional wearable terminals used in an environment where peripherals and their cords are susceptible to snagging.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Although the invention will be described next in relation to certain embodiments, the invention is not limited to practice in any one specific type of portable or wearable terminal. It is contemplated that the principles of the invention can be used with a variety of electronic devices, including but not limited to wearable, portable and/or mobile terminals for use with inventory systems. The description of the invention is intended to cover all alternatives, modifications, and equivalent arrangements as may be included within the spirit and scope of the invention as defined by the appended claims. In particular, those skilled in the art will recognize that the components of the invention described herein could be arranged in multiple different ways.

Figure 1:
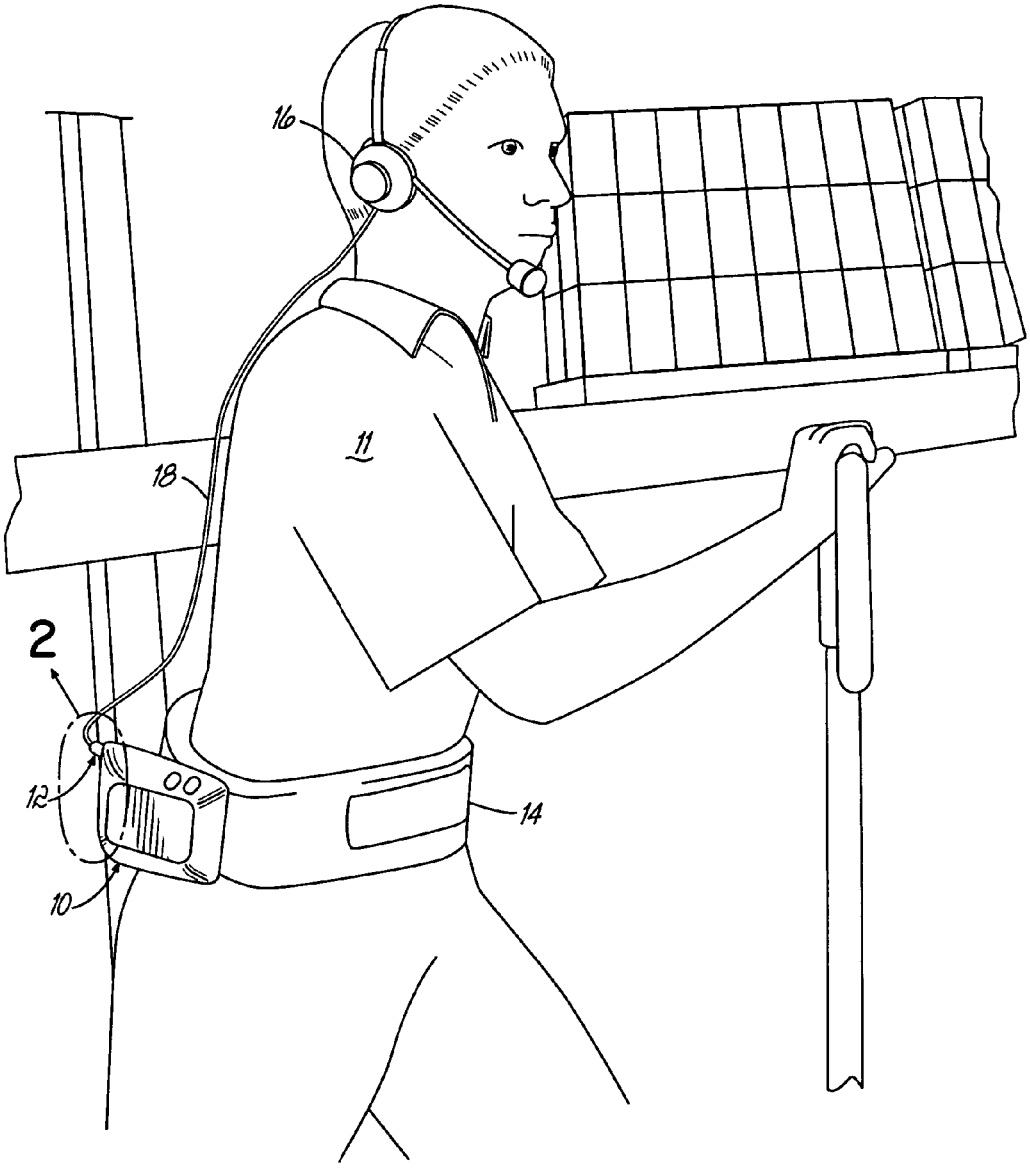
FIG. 1 is an illustration of a wearable terminal incorporating the present invention.
Figure 1A:
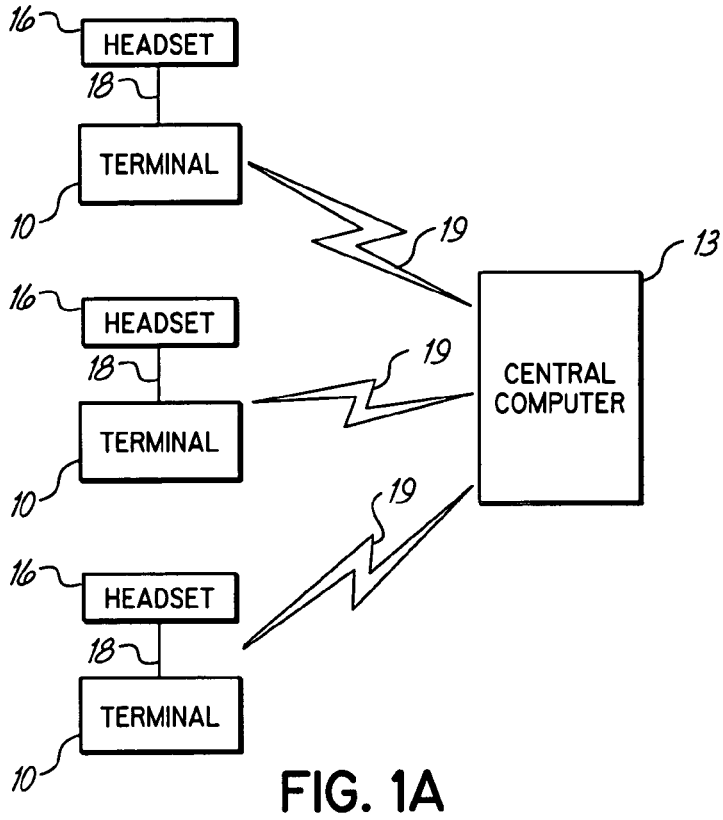
FIG. 1A is a schematic block diagram of a system incorporating the present invention.

Referring to FIGS. 1 and 1A, a portable or wearable terminal 10 may be worn by a worker on a belt 14 and is connected to a peripheral device 16, such as a voice headset, by a cord 18 that is coupled to the terminal 10 by a break-away connector 12. Such wearable terminals 10 may be used in inventory management environments where workers 11, each using one of the wearable terminals 10, are required to retrieve various items within the warehouse. The wearable terminal 10 and peripheral 16 may permit the worker 11 to communicate bi-directionally, such as with a wireless link 19, with a central computer system 13 (FIG. 1A), or other information system, to send and receive information regarding the activities performed by the worker 11 and the inventory being managed. One suitable wearable terminal 10 for incorporating the invention is the TALKMAN® product available from Vocollect, Inc. of Pittsburgh, Pa.

The peripheral device 16 is adapted with a transducer that generates a signal in response to a suitable input, such as voice input, from the worker 11 and the cord 18 electrically couples the peripheral device 16 with the wearable terminal 10 for transferring the signal from peripheral device 16 to the wearable terminal 10. The central computer system 13 constitutes part of a larger system for sending and receiving information regarding the activities and tasks to be performed by the worker 11. The central computer system 13 may run one or more system software packages for handling a particular task, such as inventory and warehouse management. The peripheral device 16 may also include another transducer that translates information received from the computer system 13 into a format understood aurally by the worker 11.

In a certain environments in which inventories are managed, the cord 18 connecting the peripheral 16 with the terminal 10 may become snagged or entangled, such as on shelving structures or equipment, for example, used to transport the items collected from the inventory. Therefore, it is desirable to have connector 12 which provides a secure electrical connection between cord 18 and terminal 10, but which will break away at a specified break-away force whereby the connector 12 becomes uncoupled or disconnected from the terminal 10 to prevent damage to the terminal 10, peripheral 16 or cord 18.

Figure 2:
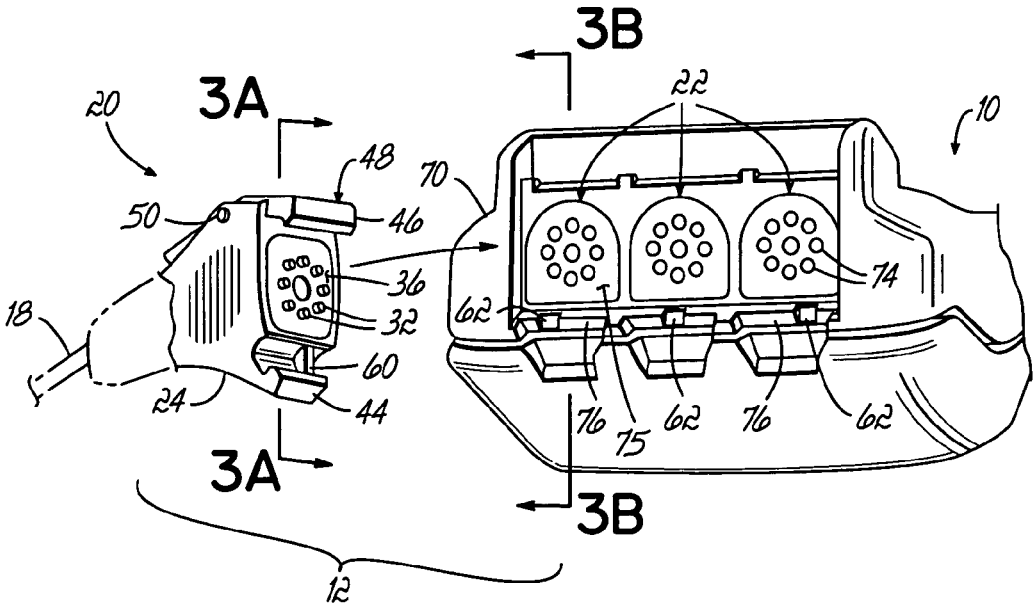
FIG. 2 is an enlarged, exploded view of the encircled area 2 of FIG. 1, depicting an embodiment of the present invention.

FIG. 2 shows detail of the exemplary connector 12 comprising two portions, a plug portion 20 and a terminal portion or socket portion 22. The portions 20, 22 are shown uncoupled in FIG. 2 for clarity. Advantageously, plug portion 20 may be coupled to terminal portion 22 to provide an electric connection between a peripheral device 16 and the wearable terminal 10 via contacts 32, such as pins, on the plug portion 20 and corresponding contacts 74 on the terminal portion 22. The wearable terminal 10 may have a terminal portion for a single connector 12, or may be provided with multiple terminal portions 22 for the coupling of multiple plug portions 20, as depicted in FIG. 2. When multiple connectors 12 are used, the plug and terminal portions 20, 22 may be provided with keys 60 and corresponding keyways or key slots 62, respectively, to ensure that the appropriate plug portion 20 is coupled to its respective terminal portion 22.

Figure 3:
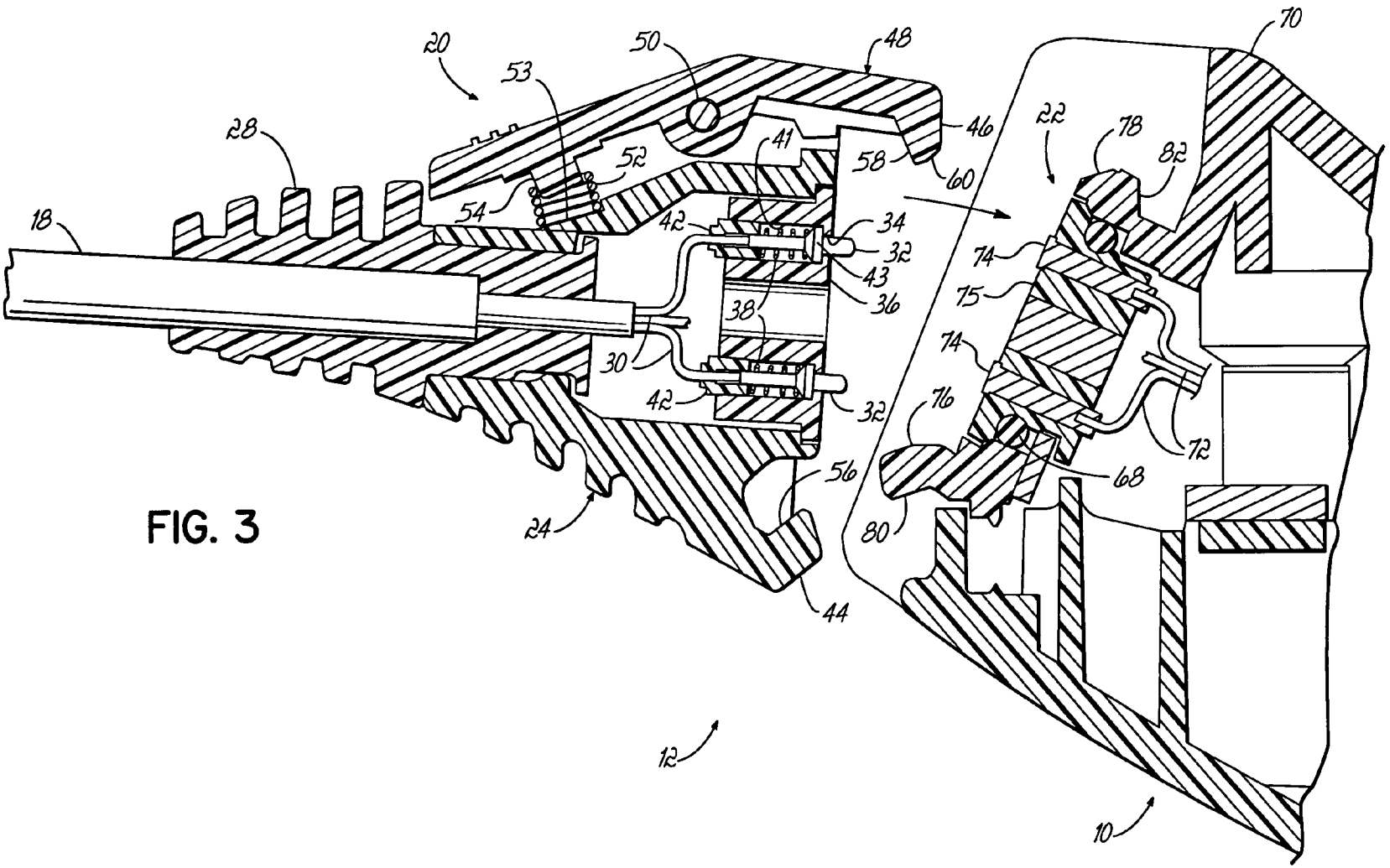
FIG. 3 is a cross-sectional view taken generally along lines 3A-3A and 3B-3B of FIG. 2.
Figure 4:
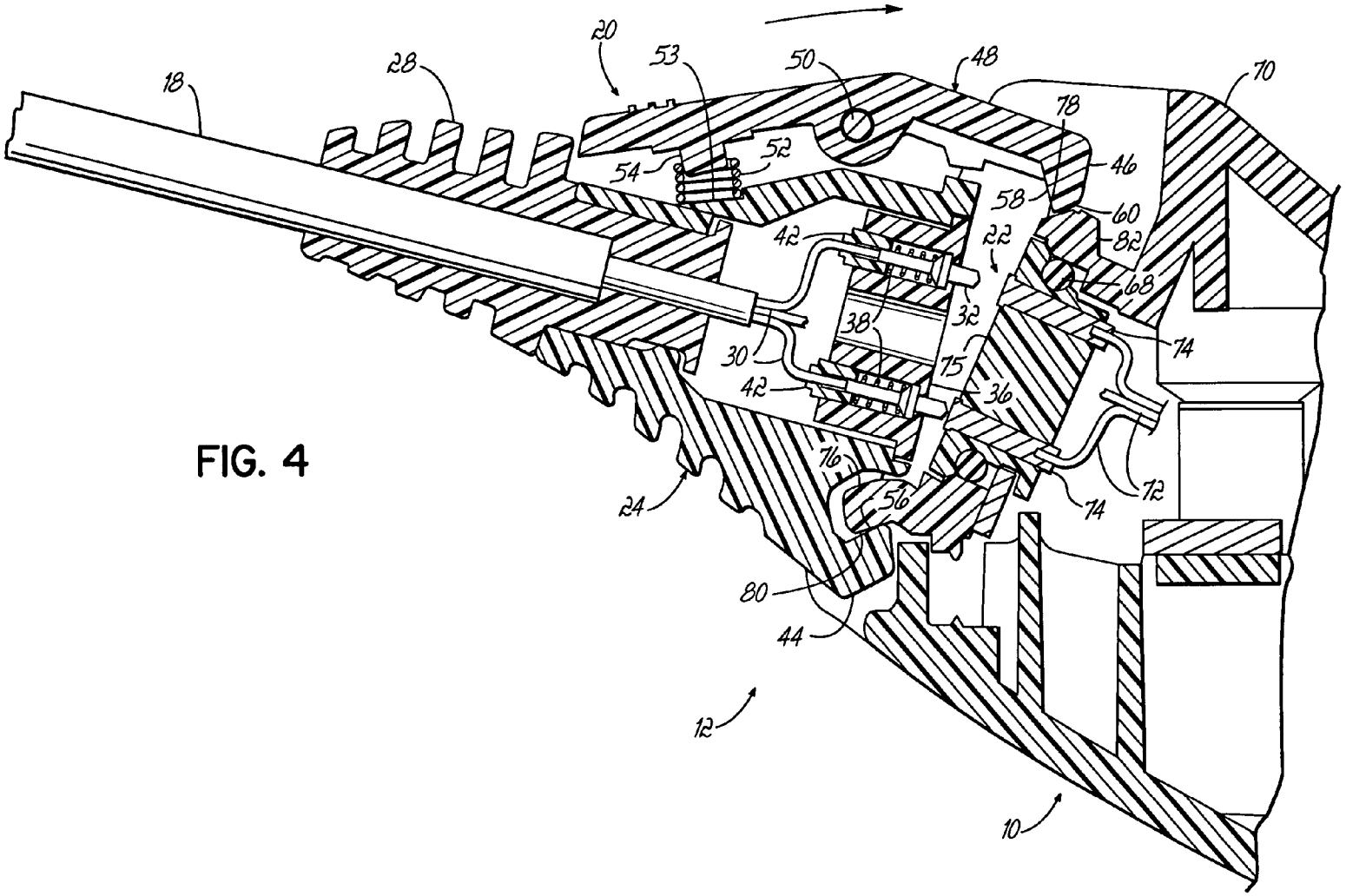
FIG. 4 is a cross-sectional view of the connector of FIG. 3, showing the plug and terminal portions just prior to coupling.
Figure 5:
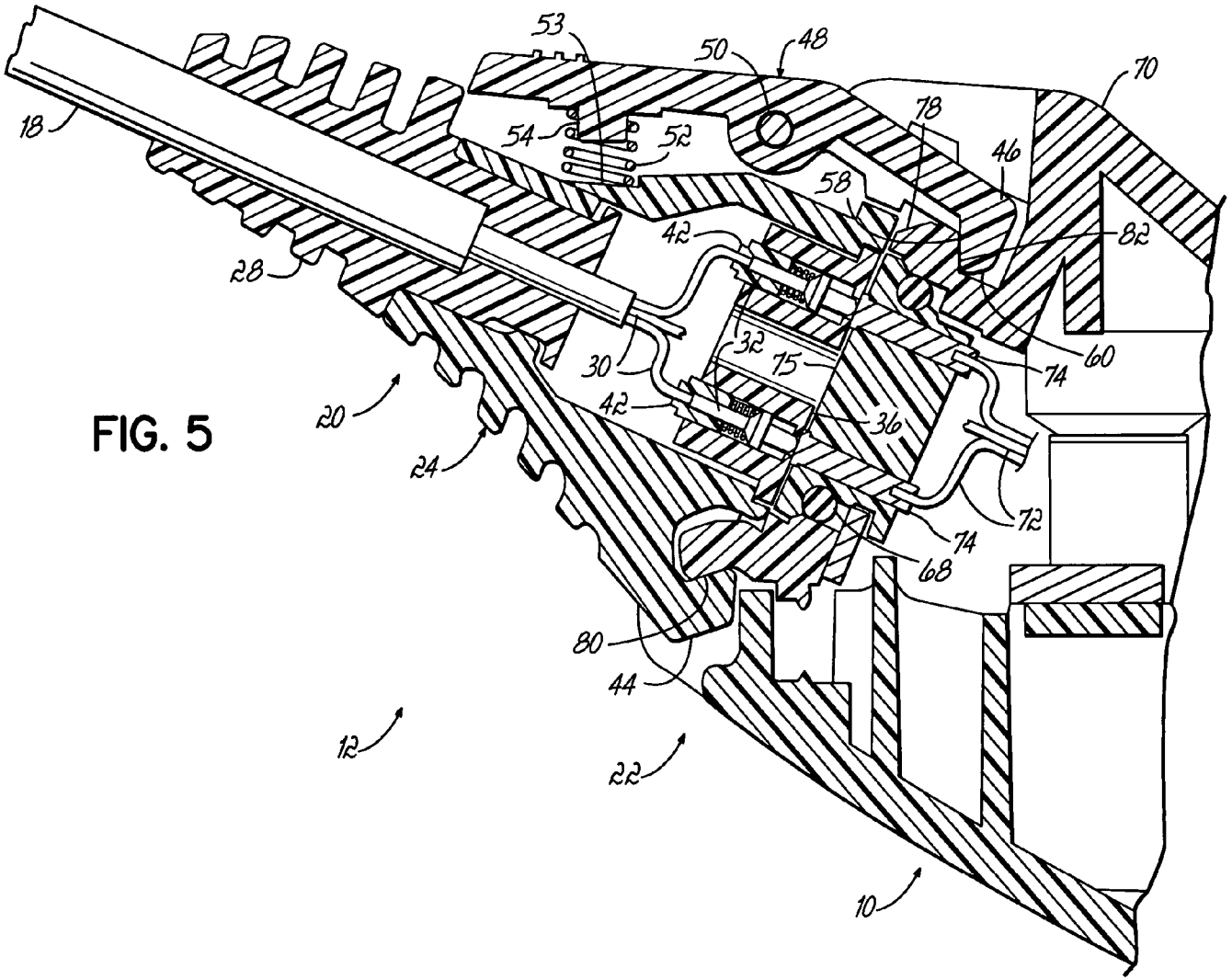
FIG. 5 is a cross-sectional view of the connector of FIG. 3, depicting the plug and terminal portions coupled together.

FIGS. 3-5 show cross-sectional views of the plug and terminal portions 20, 22 of an exemplary electrical connector 12 of FIG. 2. The plug portion 20 includes a plug housing 24 which is configured to be attached to an end of a multi-conductor cord or cable 18. A strain relief 28 provided at one end of the plug housing 24 helps to retain the multi-conductor cord 18 and participates in preventing damage to individual conductors 30 within the cord 18 which may be caused by tension applied to the cord 18.

Individual conductors 30 of the multi-conductor cord 18 are separated within the plug housing 24 and are electrically coupled with respective electrical contacts 32. In the exemplary plug portion 20 shown, the electrical contacts 32 are retractable contacts, such as pogo pin contacts. The contacts 32 protrude through apertures 34 provided in a mating surface 36 of the plug portion 20. The contacts 32 have respective biasing members or springs 38 that bias the pins 32 in a direction toward the mating surface 36, and which also permit the contacts 32 to be displaced such that they are substantially flush with the mating surface 36 when the plug portion 20 couples with the terminal portion.

Each contact 32 is provided with an insert 42, such as a solder cup, that is press-fit into a corresponding cavity 41 provided in the plug housing 24. Each spring 38 is compressed between the insert 42 and a frustoconical portion 43 of the respective contact 32. The insert 42 also electrically couples each conductor 30 of the multi-conductor cord 18 with a corresponding one of the electrical contacts 32. The insert 42 operates to seal off the junction between each conductor 30 and the corresponding contact 32 from moisture infiltrating about the contact 32 into the associated cavity 41.

When the wearable terminal 10 is used in alternatingly warm, humid environments, such as a warehouse or the outdoors, and cold, dry environments, such as a storage freezer, there may be a tendency for the condensation which develops on the connector 12 to freeze, potentially interfering with the electrical contacts. Advantageously, the spring force of the springs 38 on contacts 32 may be selected such that the spring force will break off any ice which may have formed over the contacts 32, when the connector portions are uncoupled and the contacts 32 are moved toward their extended positions by springs 38.

With continued reference to FIGS. 3-5, the plug portion 20 further includes first and second engagement claws 44, 46 which are used to secure the plug portion 20 to the terminal portion 22 in a break-away fashion in accordance with the principles of the present invention. The first engagement claw 44 is provided on one part of the plug housing 24 such as by being formed with the housing, for example. The second engagement claw 46 is provided on a lever arm 48 which is pivotally mounted by a pin 50 to another part of the plug housing 24, such that the second engagement claw 46 is positioned substantially opposite the first engagement claw 44 on the housing 24. A biasing member or spring 52 disposed between the lever arm 48 and the plug housing 24 biases the arm 48 in one direction toward a first position for engaging the terminal portion 22 of connector 12 when coupled thereto. The lever arm 48 may be pivoted in the opposite direction toward a second position for coupling and uncoupling the plug and terminal portions 20, 22 by rotating the lever arm 48 about the pin 50 against the force of spring 52. A protrusion 54 formed into one end of the lever arm 48 helps to retain the spring 52 in position on the plug housing 24 along with a cavity 53 in the housing.

Figure 6:
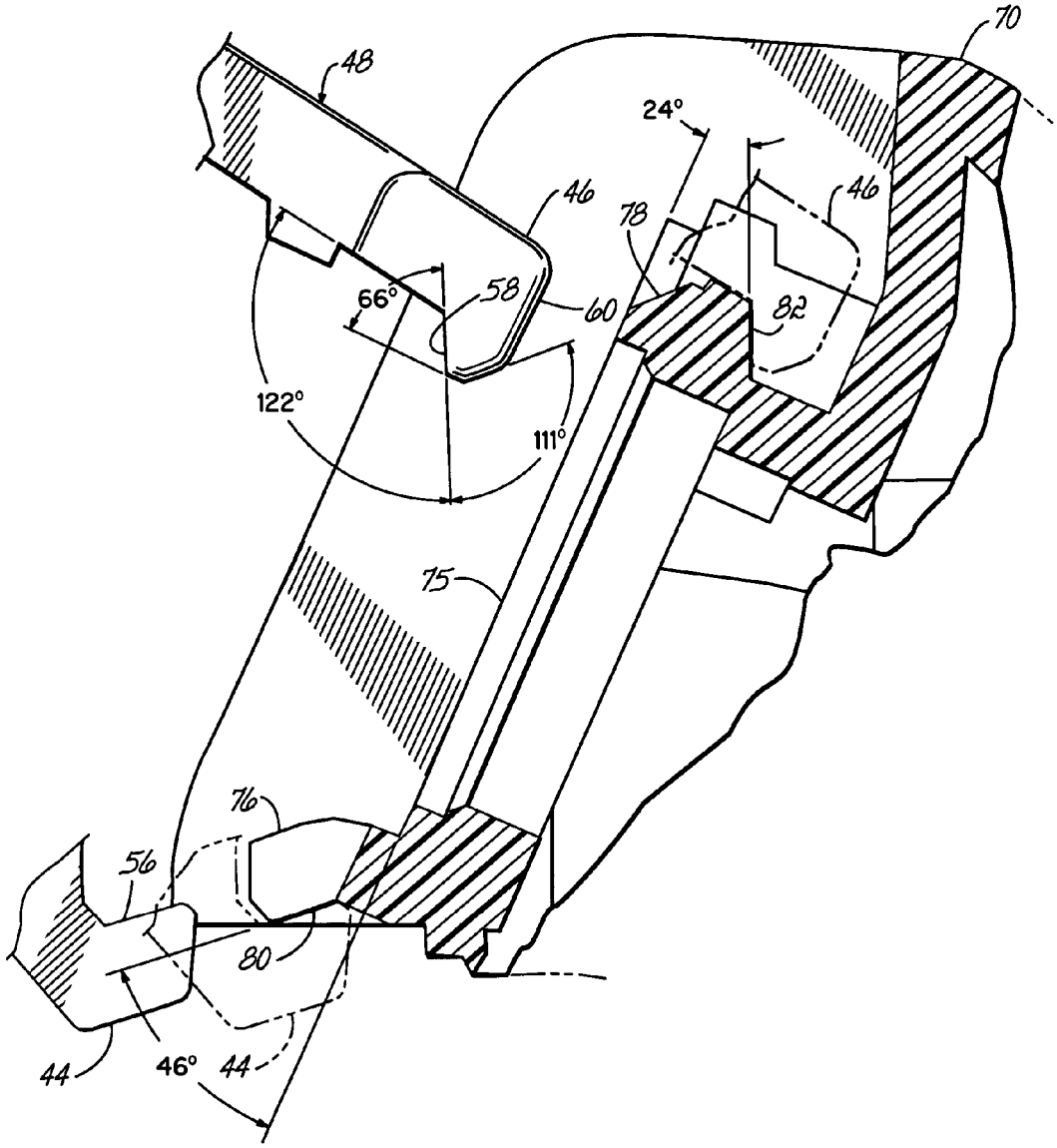
FIG. 6 is a view showing detail of the terminal housing in cross-section and the lever arm and engagement claws in elevation.

The first and second engagement claws 44, 46 have angled surfaces 56, 58, respectively, which facilitate coupling the plug portion 20 with the terminal portion 22. The second engagement claw 46 on lever arm 48 has a leading edge 60 which is angled to facilitate coupling the plug portion 20 with the terminal portion 22, whereby contact between leading edge 60 and the second engagement lip 78 urges lever arm 48 from the first position toward the second position, against the opposing bias force created by spring 52. In an exemplary embodiment, leading edge 60 is angled approximately 111° from a surface parallel to the angled surface 58 of second engagement claw 46, as depicted in FIG. 6. The angled surfaces 56, 58 also permit the plug portion 20 to become uncoupled from the terminal portion 22 when a specified force is applied to the plug portion 20, as will be described more fully below.

With continued reference to FIGS. 3-5, the terminal portion 22 of the electrical connector 12 includes a terminal housing 70 which is configured to mate with the plug housing 24. The terminal housing 70 may be connected to, or formed integrally with the housing of a device, such as wearable terminal 10, with which the electrical connector 12 is used. One or more conductors 72 are routed to the terminal portion 22 and are attached to electrical contacts 74 which are configured to mate with corresponding electrical contacts 32 of the plug portion 20. Therefore, the contacts 74 are arranged generally in the same fashion as the contacts 32 as seen in FIG. 2. In the exemplary electrical connector 12 shown, the electrical contacts 74 have flat ends which protrude just above, but generally flush with, a mating surface 75 of the terminal portion 22 (as opposed to the upraised pins 32) which is configured to interface with the mating surface 36 of the plug portion 20.

As shown in FIGS. 4 and 5, the terminal contacts 74 are configured to mate with the contacts 32 of the plug portion 20 when the plug portion 20 is coupled to the terminal portion 22. An O-ring 68 positioned inside the terminal housing 70 seals the interior of the housing 70 to protect the conductor-contact interface against moisture infiltration. While the contacts 32, 74 shown in the exemplary embodiment are pogo pins and flat contacts configured to mate with the pogo pins, it will be understood that the contacts 32, 74 may be of various other configurations as are known in the art.

As shown in FIGS. 3-5, the terminal housing 70 includes first and second engagement lips 76, 78 which are configured to mate with the first and second engagement claws 44, 46 of the plug portion 20 when the plug portion 20 is coupled to the terminal portion 22. The first and second engagement lips 76, 78 have angled surfaces 80, 82 which correspond to the angled surfaces 56, 58 of the first and second engagement claws 44, 46, respectively, whereby the contact between the first and second engagement claws 44, 46 and first and second engagement lips 76, 78 retains the plug portion 20 on the terminal portion 20, as shown in FIG. 5. When the plug portion 20 and the terminal portion 22 are coupled together, the mating surfaces 36, 75 of the plug and terminal portions 20, 22 interface with one another such that the contacts 32 on the plug portion 20 and the contacts 74 on the terminal portion 22 are in full contact.

Advantageously, the angled surfaces 56, 58, 80, 82 on the first and second engagement claws 44, 46 and on the corresponding first and second engagement lips 76, 78 act in cooperation with the spring 52 on the plug portion 20 to allow the plug portion 20 to break away from the terminal portion 22 when force of a specific magnitude is applied to the plug portion 20. This force may be applied to the plug portion 20 through the cord 18 connected to the plug housing 24, such as when the cord 18 becomes snagged on an object or machine. Accordingly, the angled surfaces 56, 58, 80, 82 on the first and second engagement claws 44, 46 and the first and second engagement lips 76, 78 may be selected, in conjunction with a given spring constant of the spring 52 on the plug housing 24 to permit the plug portion 20 to break away from the terminal portion 22 at a predetermined break-away force. This break-away force may be applied to the plug portion 20 in any direction, such as normal to the mating surface 36, tangential to the mating surface 36, or generally any angular direction therebetween.

When the force applied to plug portion 20 reaches the predetermined break-away force value, lever arm 48 is caused to rotate about pin 50 toward the second position, whereby plug portion 20 may become uncoupled from terminal portion 22. The relationship between the angled surfaces 58, 82 is such that the relative length dimensions of corresponding surfaces 58 and 82 determine the amount of rotation of lever arm 48 about pin 50 against the force created by the accompanying compression of spring 52.

Advantageously, the break-away force may be specified such that the plug connector portion 20 will remain coupled to the terminal portion 22 during normal operation of the terminal 10, but permits the plug portion 20 to uncouple from the terminal portion 22 when the force applied to the plug portion 20 through the cord 18 reaches the specified break-away force to thereby prevent damage to the electrical connector 12, or to prevent hindering the user of terminal 10. For example, the orientation of the angled surfaces 56, 58, 80, 82 and the spring constant of spring 52 may be selected such that the break-away force is approximately equal to a force at which cord 18 has been rated to operate without sustaining damage, multiplied by a design factor.

Generally, the force for which the cord 18 is rated to operate without sustaining damage is specified by the manufacturer of the cord. The design factor generally has a value less than 1 and is applied to the rated force to account for variations in material properties, the number of loadings which may be experienced by the cord, the durability of the cord over time, and other considerations which add uncertainty to the determination of a proper rating for the cord. In an exemplary embodiment, cord 18 is rated for about 40 pounds and the design factor is selected to range from about 0.25 to about 0.33, whereby the desired break-away force is about 10 pounds.

With reference to FIG. 6 and in an exemplary embodiment, the first engagement claw 44 has an angled surface 56 oriented approximately 46° from the mating surface 36 of the plug portion 20 and the second engagement claw 46 has an angled surface 58 oriented approximately 24° from the mating surface 36 of the plug portion 20 when the lever arm 48 is in the first position, as depicted by phantom lines in FIG. 6. In the exemplary embodiment, the 24° angle of the surface 58 of second engagement claw 46 corresponds to an angle of approximately 122° from a surface which is parallel to a longitudinal axis of lever arm 48, as shown in FIG. 6. The terminal portion 22 of the exemplary embodiment has first and second engagement lips 76, 78 with angled surfaces 80, 82 oriented at approximately 46° and 24°, respectively, from a plane containing the mating surface 75 of the terminal portion 22. When the spring constant of the spring 52 is 81.5 lb/in., the break-away force of the exemplary electrical connector 12 is in the range of approximately 8 to 12 pounds. Of course, other selected break-away force ranges may be used, such as by varying the spring force of spring 52 or the angles of the respective angled surfaces on the engagement claws 44, 46 and lips 76, 78. Generally, the break-away force may range from about 3 pounds to about 15 pounds without departing from the spirit and scope of the invention.

The plug housing 24, terminal housing 70, and arm 48 may be formed from polymeric material. In an exemplary embodiment, the plug housing 24, terminal housing 70, and arm 48 are formed from XENOY®, a thermoplastic resin available from GE Plastics, Seven Hills, Ohio. This polymer has good low temperature characteristics useful when the connector 12 is exposed to low temperatures.

With reference to FIGS. 3-5, coupling of the plug portion 20 with the terminal portion 22 will be described. In use, the connector 12 of the present invention may be used to couple a peripheral device 16, such as a headset, to a wearable terminal 10 or other device. The worker depresses lever arm 48 on the plug portion 20 to move the arm 48 toward the second position and brings the first engagement claw 44 on the plug portion 20 into engagement with the first engagement lip 76 on the terminal portion 22. The corresponding keys 60 and keyways 62 will ensure that the proper plug portion 20 is coupled with the proper terminal portion 22. The worker then urges the second engagement claw 46 into engagement with second engagement lip 78, whereby the angled leading edge 60 of the second engagement claw 46 facilitates engagement of the claw 46 with second engagement lip 78. Mating surfaces 36, 75 are brought into substantially abutting relation and contacts 32, 74 are in full contact with one another. The plug portion 20 and terminal portion 22 are fully coupled and the worker may then release lever arm 48. Advantageously, the connector 12 securely couples peripheral 16 to wearable terminal 10 during normal activities of the worker. However, if a cord 18 between peripheral 16 and plug portion 20 should become snagged on an object, the plug portion 20 will become uncoupled from terminal portion 22 when the force applied to plug portion 20 through cord 18 reaches the specific break-away force to thereby prevent damage to terminal 10, connector 12 or cord 18 while allowing a clean beak-away for the worker. The connector 12 may then be easily coupled or re-secured with the terminal 10 for further use.

While described herein with regard to a wearable terminal 10, it will be appreciated that the exemplary connector 12 is applicable to other wearable, portable and mobile electronic devices connected by a wire or cord to a peripheral device. Moreover, while an exemplary embodiment is disclosed herein with respect to a voice headset, other peripherals 16 may also be utilized equally with the present invention. For example, bar code readers, scanners, printers and other peripherals which might be coupled to terminal 10 through cord 18 will also benefit from the aspects of the present invention. Furthermore, while an exemplary embodiment is described with respect to use of the invention and a portable terminal 10 in an inventory management environment, the principles of the invention will have equal applicability to other terminals or electronic devices, and other operating environments.

While the present invention has been illustrated by the description of the various embodiments thereof, and while the embodiments have been described in considerable detail, it is not intended to restrict or in any way limit the scope of the appended claims to such detail. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of Applicants' general inventive concept.

What is claimed is:

1. A connector for coupling a cord of a peripheral device with a terminal device, the connector comprising:

a plug member configured for being coupled with an end of a cord, the plug member including a housing having a generally planar mating surface configured to mate against a connector surface of a housing of the terminal device, the plug member including a plurality of biased contacts that are biased to extend forward of the mating surface;

a stationary engagement claw formed with the housing and positioned proximate one end of the mating surface, the stationary engagement claw having an angled surface configured to connect with an angled surface of an engagement lip on the housing of the terminal device;

the angled surface of the stationary engagement claw being angled approximately 46 degrees with respect to the generally planar mating surface of the plug member;

a pivoting engagement claw positioned proximate another end of the mating surface opposite the stationary engagement claw and having an angled surface, the pivoting engagement claw being coupled to a lever arm and configured to be moved by force on the lever arm for pivoting between a first position to engage a second angled surface proximate the connector surface of the terminal device and a second position to disengage from the second angled surface;

a force element for providing a force on the lever arm in a direction that pivots the pivoting engagement claw toward the first position;

the engagement claws, with the lever pivoted toward the first position, simultaneously engaging the respective complementary angled surfaces and directing the mating surface toward the connector surface to press the biased contacts against the connector surface.

2. The connector of claim 1 wherein the angled surface of the stationary engagement claw is positioned rearwardly of the planar mating surface.

3. The connector of claim 1 wherein the angled surface of the pivoting engagement claw is positioned forwardly of the planar mating surface.

4. The connector of claim 1 further comprising a key structure positioned proximate the stationary engagement claw, the key structure configured for engaging a keyway of the terminal device.

5. The connector of claim 1 wherein the force element for providing a force on the lever arm includes a spring.

6. The connector of claim 1 wherein the force element provides a force on the lever arm to push the lever arm away from the connector housing for pivoting the pivoting engagement claw to the first position to engage the second angled surface.

7. The connector of claim 1 wherein the force element may be manipulated to release the force on the lever arm and to allow the lever arm to move towards the connector housing for pivoting the pivoting engagement claw to the second position to disengage from the second angled surface.

8. The connector of claim 1 wherein the pivoting engagement claw angled surface is angled approximately 24 degrees with respect to the generally planar mating surface.

9. A connector for coupling a cord of a peripheral device with a terminal device, the connector comprising:

a plug member configured for being coupled with an end of a cord, the plug member including a housing having a generally planar mating surface configured to mate against a connector surface of a housing of the terminal device, the plug member including a plurality of biased contacts that are biased to extend forward of the mating surface;

a stationary engagement claw formed with the housing and positioned proximate one end of the mating surface, the stationary engagement claw having an angled surface configured to connect with an angled surface of an engagement lip on the housing of the terminal device;

the angled surface of the stationary engagement claw being angled approximately 46 degrees with respect to the generally planar mating surface of the plug member;

a pivoting engagement claw positioned proximate another end of the mating surface opposite the stationary engagement claw and having an angled surface, the angled surface of the pivoting engagement claw being angled approximately 24 degrees with respect to the generally planar mating surface;

the pivoting engagement claw being coupled to a lever arm and configured to be moved by force on the lever arm for pivoting between a first position to engage a second angled surface proximate the connector surface of the terminal device and a second position to disengage from the second angled surface;

a force element for providing a force on the lever arm in a direction that pivots the pivoting engagement claw toward the first position;

the engagement claws, with the lever pivoted toward the first position, simultaneously engaging the respective angled surfaces and directing the mating surface toward the connector surface to press the biased contacts against the connector surface.

10. A cord for connecting a peripheral device with a terminal device, the cord comprising:

a plurality of conductors;

a plug member configured for being coupled with the plurality of conductors at ends thereof, the plug member including a housing having a generally planar mating surface configured to mate against a connector surface of a housing of the terminal device, the plug member including a plurality of biased contacts, the biased contacts being electrically coupled with the plurality of conductors and biased to extend forward of the mating surface;

a stationary engagement claw formed with the housing and positioned proximate one end of the mating surface, the stationary engagement claw having an angled surface configured to connect with an angled surface of an engagement lip on the housing of the terminal device;

the angled surface of the stationary engagement claw being angled approximately 46 degrees with respect to the generally planar mating surface of the plug member;

a pivoting engagement claw positioned proximate another end of the mating surface opposite the stationary engagement claw and having an angled surface, the angled surface of the pivoting engagement claw being angled approximately 24 degrees with respect to the generally planar mating surface;

the pivoting engagement claw being coupled to a lever arm and configured to be moved by force on the lever arm for pivoting between a first position to engage a second angled surface proximate the connector surface of the terminal device and a second position to disengage from the second angled surface;

a force element for providing a force on the lever arm in a direction that pivots the pivoting engagement claw toward the first position;

the engagement claws, with the lever pivoted toward the first position, simultaneously engaging the respective angled surfaces and directing the mating surface toward the connector surface to press the biased contacts against the connector surface.

* * * * *

UNITED STATES PATENT AND TRADEMARK OFFICE

CERTIFICATE OF CORRECTION

PATENT NO. : 8,128,422 B2
APPLICATION NO. : 10/982967
DATED : March 6, 2012
INVENTOR(S) : Mark Bradford Mellott et al.

It is certified that error appears in the above-identified patent and that said Letters Patent is hereby corrected as shown below:

Title Page, under Item (56), References Cited, U.S. Patent Documents, insert --6,335,860, 01/2002, Shin--.

In the Specification:

In Column 3, Line 43 reads "In a certain environments . . ." and should read --In certain environments . . .--.

In Column 5, Line 53 reads ". . . terminal portion 20, as shown . . ." and should read --. . . terminal portion 22, as shown . . .--.

In the Claims:

In Column 8, Line 34, CLAIM 1 reads ". . . complementary angled surfaces and . . ." and should read --. . . angled surfaces and . . .--.

Signed and Sealed this
Twenty-ninth Day of April, 2014

Michelle K. Lee

Michelle K. Lee
*Deputy Director of the United States Patent and Trademark Office*